US009649652B2

(12) United States Patent
Hildre

(10) Patent No.: US 9,649,652 B2
(45) Date of Patent: May 16, 2017

(54) PAINT SHIELD AND PAINT SHIELDING METHODS

(71) Applicant: BUCKET TOOLS, LLC, Zimmerman, MN (US)

(72) Inventor: Ben Hildre, Zimmerman, MN (US)

( * ) Notice: Subject to any disclaimer, the term of this patent is extended or adjusted under 35 U.S.C. 154(b) by 0 days.

(21) Appl. No.: 14/660,394

(22) Filed: Mar. 17, 2015

(65) Prior Publication Data

US 2015/0258562 A1 Sep. 17, 2015

Related U.S. Application Data

(60) Provisional application No. 61/954,320, filed on Mar. 17, 2014.

(51) Int. Cl.
*B05B 15/04* (2006.01)
*B05C 21/00* (2006.01)

(52) U.S. Cl.
CPC ..... *B05B 15/04* (2013.01); *B05B 15/0475* (2013.01); *B05C 21/005* (2013.01)

(58) Field of Classification Search
None
See application file for complete search history.

(56) References Cited

U.S. PATENT DOCUMENTS 1,292,071 A * 1/1919 Roe ..... B05B 15/0475 118/504
1,411,462 A 4/1922 Wendt
2,098,005 A * 11/1937 Holt ..... B05B 15/0475 118/504
2,332,579 A 10/1943 Kirby
2,698,003 A 12/1954 Bullock
2,726,633 A * 12/1955 Miron ..... B05B 15/0475 118/504
2,754,799 A * 7/1956 Crawford ..... B44D 3/225 118/504
2,889,804 A * 6/1959 Jacob ..... B05B 15/0475 118/504
3,039,433 A 6/1962 Kormuth
3,565,038 A * 2/1971 Van Barriger ..... B05B 15/0475 118/504
3,633,542 A 1/1972 Read
3,693,589 A * 9/1972 Knox ..... B05B 15/0475 118/504
3,788,274 A * 1/1974 McNaughton ..... B05B 15/0475 118/504
4,051,808 A * 10/1977 Trupp ..... B05B 15/0475 118/504
4,258,654 A 3/1981 Ivankovich
4,357,898 A 11/1982 Fehrenbacher
4,398,495 A 8/1983 Harris, Jr. et al.
4,536,913 A * 8/1985 Morawski ..... B05B 15/0475 118/504
4,791,007 A * 12/1988 Gleason ..... B05B 15/0475 118/504

(Continued)

*Primary Examiner* — Binu Thomas
(74) *Attorney, Agent, or Firm* — Dicke, Billig & Czaja, PLLC

(57) ABSTRACT

Some examples include a paint shield having an arcuate portion terminating in a first edge and an elongated portion comprising a first section and a second section. The first section is disposed at an angle from the second section. The first section is positioned between the arcuate portion and the second section. The second section terminates in a second edge.

13 Claims, 2 Drawing Sheets

(56) References Cited

U.S. PATENT DOCUMENTS

| | | | | |
|---|---|---|---|---|
| 5,103,762 | A | 4/1992 | Long et al. | |
| 6,808,794 | B1 | 10/2004 | Mattox | |
| 8,104,426 | B2 | 1/2012 | Gringer | |
| 2004/0255975 | A1* | 12/2004 | Stiles | B05B 15/0475 118/504 |
| 2008/0092811 | A1* | 4/2008 | Kim | B05B 15/0443 118/504 |

* cited by examiner

PAINT SHIELD AND PAINT SHIELDING METHODS

CROSS-REFERENCE TO RELATED APPLICATIONS

This application claims priority under 35 U.S.C. §119(e)(1) to U.S. Provisional Patent Application Ser. No. 61/954,320, filed Mar. 17, 2014, entitled "Paint Shield and Paint Shielding Methods", and the entire teachings of which are incorporated herein by reference.

BACKGROUND

This invention relates to a paint shield used in residential and commercial painting applications. When painting, it is desirable to protect surfaces not designated to receive paint from the misapplication of paint and other coating material. For example, it is often desirable to paint the main wall surface but not the baseboard at the bottom of the wall. Currently, there are many available masking and shielding materials and techniques that are inefficient.

For example, tape is often used to mask edges and other surfaces. In practice, applying masking tape is awkward and time consuming, requiring considerable labor and cost. Additionally, the tape can only be used once and then must be removed and discarding. Also, the tape cannot always in practice be applied with the precision required for a satisfactory job. For these and similar reasons, many painters try to do the job without any masking at all, thereby almost invariably leaving unsightly paint dabs.

To avoid the problems associated with masking tape and to protect a non-designated surface from the misapplication of paint and other coating materials, painters have improvised by using spray shield formed with a flat strip of cardboard, plastic, or other material. These flat shields are manually held or taped in place during painting.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Figure 1:
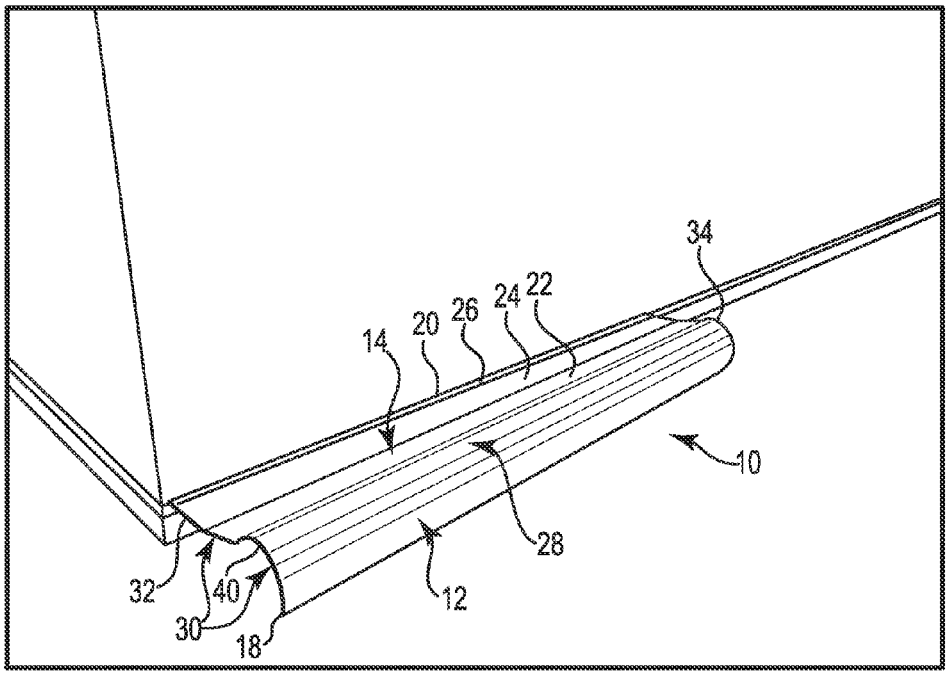
FIG. 1 is an end perspective view of an embodiment of a paint shield in accordance with aspects of the present invention.
Figure 2:
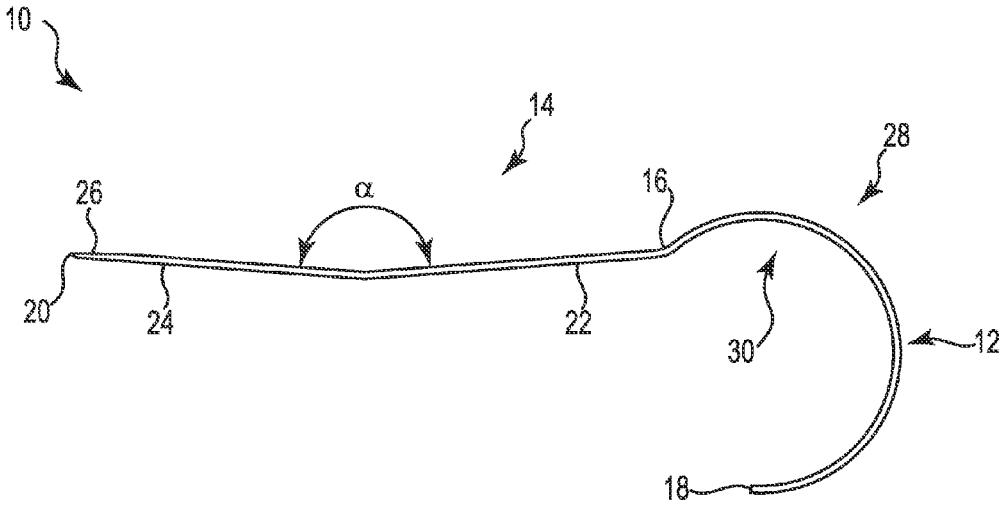
FIG. 2 is a top view of an embodiment of a paint shield in accordance with aspects of the present invention.

A paint shield 10 in accordance with aspects of the present disclosure is illustrated in FIGS. 1 and 2. The paint shield 10 has a curvilinear shape and includes an arcuate portion 12 and an elongated portion 14. The elongated portion 14 extends from the arcuate portion 12. The arcuate portion 12 extends between an intermediate edge 16 and a terminating first edge 18. In one embodiment, the arcuate portion 12 is generally semi-circular and has approximately 180° degrees of curvature, although other degrees of curvature can also be suitable. The arcuate portion 12 can have a diameter that corresponds to a height of a standard wall baseboard. For example, the arcuate portion 12 can have a diameter in the range of 3½ inches to 4½ inches. In one embodiment, the arcuate portion 12 has a diameter of 4 inches.

The elongated portion 14 extends from the intermediate edge 16 of the arcuate portion 12. The elongated portion 14 terminates in a second edge 20 opposite the arcuate portion 12 and the first edge 18. The arcuate portion 12 is curved toward the elongate portion 14 so that the first and second edges 18, 20 extend toward the same direction. The first edge 18 is separated from the second edge 20 by at least a width of the elongated portion 14 between the intermediate edge 16 and the second edge 20 in a horizontal direction and a height or distance formed by the arcuate portion 12 a vertical direction. The elongate portion 14 includes a first section 22 and a second section 24. The first section 22 is coupled to the arcuate portion 12 between the second section 24 and the arcuate portion 12. As illustrated in FIG. 2, the first and second sections 22, 24 are each planar and disposed at an angle with respect to one another. The angle is an obtuse angle that forms a valley between the first section 22 and the second section 24.

Figure 4:
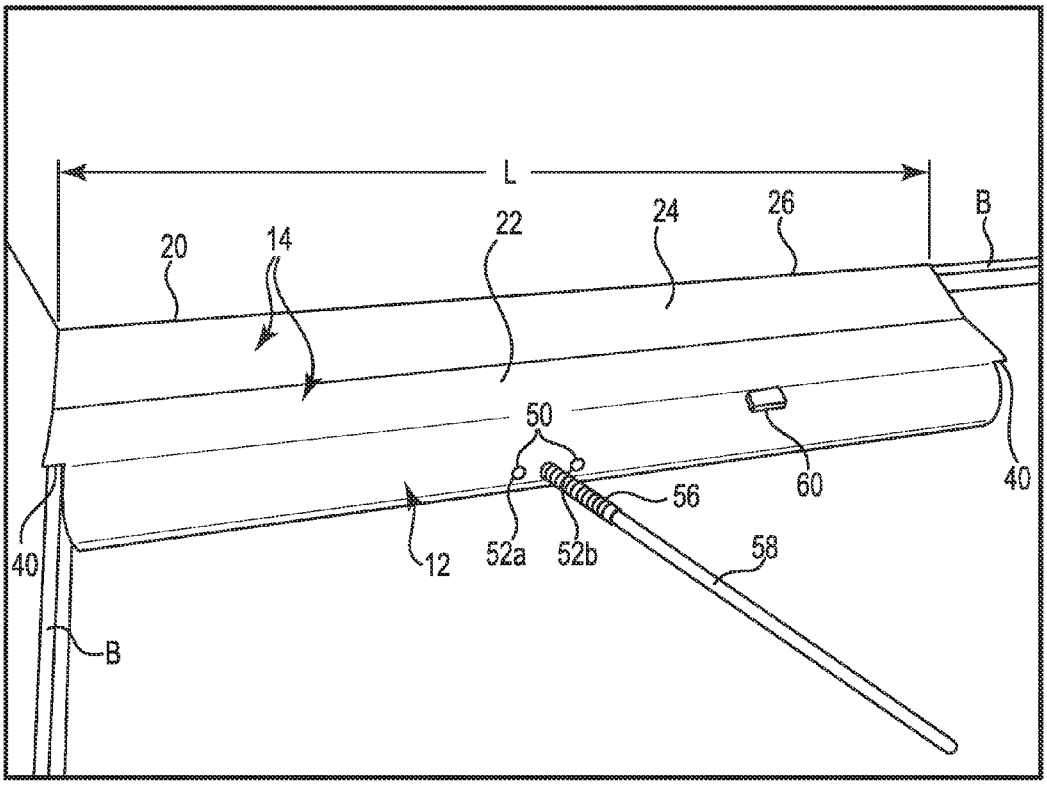
FIG. 4 is a top perspective view of an embodiment of a paint shield in accordance with aspects of the present invention.

The angled first and second sections 22, 24 can improve balance for the paint shield 10 when disposed against a base of a wall and allows excess paint (or other liquid or solid material) captured on the paint shield 10 to drain and pool on the paint shield 10 and away from the surfaces being protected. Alternatively, the elongate portion 14 can be planar, with the first and second sections 22, 24 forming a single plane. In one embodiment, the second section 24 includes a lip 26 along the second edge 20. In one embodiment, the lip 26 is angled slightly from the second portion 24 to form a horizontal surface along the top of the baseboard when positioned against. In one embodiment, the lip 26 is formed as a beveled edge section having a width sufficient to extend over a thickness of the baseboard. With reference to FIGS. 1 and 4, the elongated portion 14 extends over the baseboard and the arcuate portion 12 extends to the floor for gravitational support of the paint shield 10 with the first major surface 28 of the arcuate portion 12 contacting the floor surface and the second major surface 30 at the lip 26 contacting the baseboard extending in parallel with the length L of the paint shield 10.

With continued reference to FIGS. 1 and 2, the paint shield 10 has a first major surface 28 and a second major surface 30 opposite the first major surface 28 extending through both the arcuate portion 12 and the elongated portion 14. With additional reference to FIG. 3, the paint shield 10 has a first end 32 and an opposing second end 34 and a length L extending between the first and second ends 32, 34. The first and second ends 32, 34 are perpendicular from the first and second edges 18, 20. The first and second edges 18, 20 are straight and corners 36, 38 of the paint shield 10 are squared or slightly radiused to accommodate sheetrock, plaster and other wall or frame construction a tight, close fit to the surface being protected.

The arcuate portion 12 can include a notch 40 on at least one of the first and second ends 32, 34. As best illustrated in FIG. 4, the notch 40 is suitable to accommodate a width of a baseboard B when the length L of the paint shield 10 is positioned perpendicular to one of the baseboards B. For example, when the paint shield 10 is positioned on a floor at the intersection of two walls with the second edge 20 abutting a wall surface (i.e., in a corner of a room), the notch 40 on the first end 32 of the arcuate portion 12 provides space for the baseboard B to extend through the paint shield 10, parallel to and at the first end 32 while the elongated portion 14 is positioned directly against both of the intersecting walls (i.e., the wall extending parallel to the first end 32 and the wall extending perpendicular to the first end 32). Additionally, the notch 40 provides for multiple paint shields 10 to be assembled in a row while maintaining the second edge 20 in the same plane along the wall.

Figure 3:
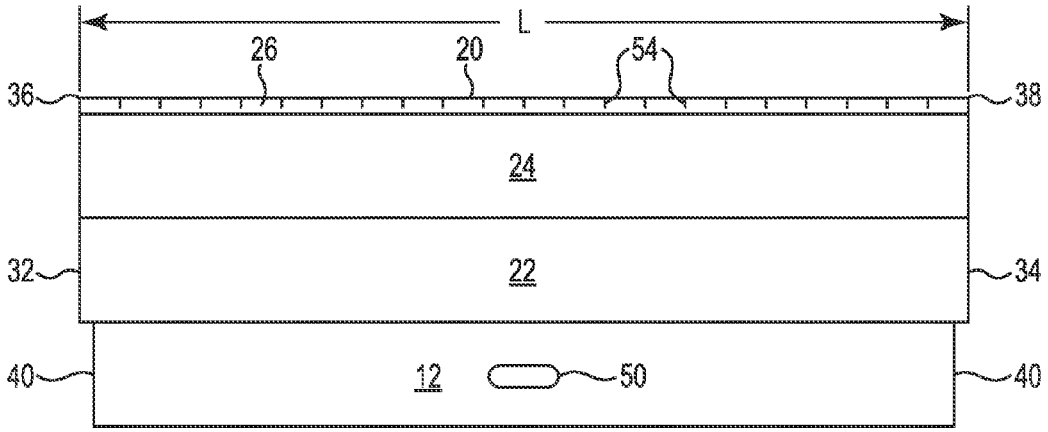
FIG. 3 is an end view of an embodiment of a paint shield in accordance with aspects of the present invention.

With reference to FIG. 3, in one embodiment, the paint shield 10 includes markings 54 along a second edge 20 to indicate various lengths of measurement. For example, the markings 54 can be spaced at ¼", ½", or 1" increments along the entire, or a portion, of the second edge 20. The paint shields 10 can be of various total lengths. For example, and without being limiting, the paint shield 10 can have a length "L" of 20" or 40".

The paint shield 10 is made of a rigid material such as aluminum sheet metal, for example. The arcuate portion 12 and elongate portion 14 are formed of a single, unitary sheet. The paint shield 10 can be made of aluminum sheet metal having a material thickness in the range of 0.032" to 0.125", for example. In one embodiment, the sheet metal material is 0.04" thick. Other materials, such as a hard plastic, are also acceptable. The material is desirably thin yet still thick enough to provide sufficient rigidity to the paint shield 10. The paint shield 10 is constructed of a smooth and nonporous material that is easily cleanable by wiping wet paint or coating material from the surfaces or scraping and/or peeling dried paint or coating material from the surfaces.

With continued reference to FIGS. 3 and 4, in one embodiment, the paint shield 10 includes a handle 50. The handle 50 can be formed as a single opening 52, or pair of openings 52*a*, 52*b*, extending through the paint shield 10, between first and second major surfaces 28, 30. In one embodiment, the handle 50 is a pair of openings 52*a*, 52*b* sized for all or some of a user's hand to extend through and formed in generally rectangular or oval shapes. When formed as a pair of openings 52*a*, 52*b*, the openings 52*a*, 52*b* are disposed a suitable distance from one another for the user's fingers to extend through both openings 52*a*, 52*b* in order for the user to grasp the shield 10. The opening(s) 52 can have rounded, or smoothed, perimeter edges and can be positioned anywhere along the arcuate portion 12. In one embodiment, opening 52 is centered along the length L and centered along a height formed by the arcuate portion 12.

In one embodiment, the paint shield 10 includes a pole connection 56 for attachment of a pole 58. The pole connection 56 is a circular opening that an end of a pole 58 can extend through, for example. At least one wing nut (not shown) can be provided to secure the pole 58 to the paint shield 10 at the pole connection 56. The pole connection 56 can be centered along the length L of the paint shield 10 for balance. In one embodiment, the pole connection 56 is centered on the radius or curvature of the arcuate portion. The pole 58 can be any commercially available pole with a threaded end as typically used with paint rollers and such. In one embodiment, a magnet 60 is provided on the first surface 28. The magnet 60 is suitable for attracting the metal on a paint brush, for example, to removably hold the brush. Any wet paint on the brush can then be directed onto the first and second sections 22, 24 of the paint shield 10.

In use, as illustrated in FIGS. 1 and 4, the paint shield 10 can be positioned on the floor with the first edge 18 of the arcuate portion 12 contacting the floor and the second edge 20 positioned against the wall directly above and contacting the wall baseboard B to protect the baseboard B and the floor adjacent to the wall that are not designated to receive paint or other coating material. The paint shield protects the baseboard B at the intersection of the wall and baseboard B during painting the edge of the wall and also protects the baseboard B and adjacent flooring from paint spatter while painting the remainder of the wall above the paint shield. A height, or the diameter, of the arcuate portion 12, when corresponding to the height of the baseboard B, can provide a relatively horizontal major surface across the elongated portion 14. To protect baseboards that are taller than the diameter of the arcuate portion 12, the paint shield 10 can be tilted such that the elongated portion 14 extends at an incline (an angle other than 90°) relative to the substrate in order that the second edge 20 contacts and extends along the intersection of the wall and baseboard. The arcuate portion 12 provides stability regardless of whether the elongated portion 14 is positioned relatively horizontally or at an angle less than 90° from the wall.

A tight fit of the paint shield 10 against the substrate is desirable. The edges 18, 20 and ends 32, 34 are straight and intersect squarely to provide a tight, close fit of the paint shield 10 to the substrates or surfaces being protected. A user may place pressure against the paint shield 10 toward the wall surface in order to ensure a tight fit and that the paint shield 10 remains in the desired position during use. For example, the user could place the bottom of their foot against the arcuate portion 12 with their heel remaining on the floor to exert pressure on the paint shield 10 against the substrates. The user can slide the paint shield 10 along the wall and floor as the painting proceeds along the wall in order to provide protection of surfaces at the area currently in need of protection.

Alternatively, a user can hold the paint shield 10 in a vertical, horizontal, or other angle against a substrate. For example, the user can grasp the paint shield 10 in their hand and hold it against a door or a window trim that is desired to be protected from painting. The second edge 20 of the paint shield 10 can be positioned against the edge or intersection of the surface to be protected and the surface to be coated with either the first or second major surface 28, 30 contacting the surface to be protected. The user can grasp the paint shield 10 at the handle 50, along the arcuate portion 12, or at the first or second end 32, 34 when used. Additionally, when used with the pole 58, the user can attach the shield 10 to the end of the pole 58 and hold the paint shield 10 against a surface to be protected such as when spray painting, for example. The connection of the paint shield 10 to the pole 58 can extend the distance that a user can hold the paint shield 10 for protecting the desired surface when spraying paint, for example. Wet paint can be wiped from the surfaces of the paint shield 10 as needed.

Further, the paint shield 10 is useful for directing a fluid, such as paint or water, from a source in an angled gravitational direction. The second surface 30, particularly along the arcuate portion 12, forms a channel useful for this purpose. For example, the paint shield 10 can be placed with the first end 32 under a faucet and the second end 34 in a bucket for directing the water from the faucet to the bucket. This is particularly useful when the bucket will not fit under the faucet.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A paint shield comprising:

a C-shaped arcuate portion terminating in a first edge, the arcuate portion having a diameter from 3½ inches to 4½ inches, the arcuate portion including an exterior surface and an interior surface; and an elongated portion extending from the arcuate portion opposite the first edge, the elongated portion including a first surface extending from the exterior surface and a second surface extending from the interior surface, the elongated portion comprising a first planar section and a second planar section, an obtuse angle defined along the first surface between the first planar section and the second planar section, the first planar section positioned between the arcuate portion and the second planar section, the second planar section terminating in a second edge, the second planar section including a lip extending planar with the second planar section, wherein the first surface is tapered toward the second surface at the lip to terminate at the second edge.

2. The paint shield of claim 1, wherein the arcuate portion and the elongated portion are formed of a unitary sheet.

3. The paint shield of claim 2, wherein the unitary sheet is an aluminum sheet.

4. The paint shield of claim 1, wherein the arcuate portion is curved to position the first edge in a direction toward the second edge.

5. The paint shield of claim 1, wherein the arcuate portion has a diameter of 4 inches.

6. The paint shield of claim 1, wherein the second edge is linear.

7. The paint shield of claim 1, wherein the second edge is beveled.

8. The paint shield of claim 1, wherein the arcuate portion includes at least one notched end section sized to accommodate a baseboard extending perpendicular to the second edge.

9. The paint shield of claim 1, wherein the first and second surfaces are smooth and non-porous.

10. The paint shield of claim 1, comprising incremental measurement markings positioned adjacent to the second edge.

11. The paint shield of claim 1, comprising a handle on the arcuate portion.

12. The paint shield of claim 11, wherein the handle includes an opening sized to accommodate a user's hand at least partially extending through the opening.

13. The paint shield of claim 1, comprising a pole extension connection member disposed on the arcuate portion and configured to couple with a pole extension.

* * * * *